US007895035B2

(12) United States Patent
Ehara

(10) Patent No.: US 7,895,035 B2
(45) Date of Patent: Feb. 22, 2011

(54) SCALABLE DECODING APPARATUS AND METHOD FOR CONCEALING LOST SPECTRAL PARAMETERS

(75) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 785 days.

(21) Appl. No.: 11/574,631

(22) PCT Filed: Sep. 2, 2005

(86) PCT No.: PCT/JP2005/016098

§ 371 (c)(1),
(2), (4) Date: Mar. 2, 2007

(87) PCT Pub. No.: WO2006/028009

PCT Pub. Date: Mar. 16, 2006

(65) Prior Publication Data

US 2007/0265837 A1 Nov. 15, 2007

(30) Foreign Application Priority Data

Sep. 6, 2004 (JP) ..... 2004-258925

(51) Int. Cl.
*G10L 19/00* (2006.01)

(52) U.S. Cl. ..... 704/219

(58) Field of Classification Search ..... 704/201, 704/219, 501
See application file for complete search history.

(56) References Cited

U.S. PATENT DOCUMENTS 6,208,957 B1 3/2001 Nomura
6,445,696 B1 * 9/2002 Foodeei et al. ..... 370/356
7,286,982 B2 * 10/2007 Gersho et al. ..... 704/223
7,315,815 B1 * 1/2008 Gersho et al. ..... 704/223

(Continued)

FOREIGN PATENT DOCUMENTS

CN 1418361 A 5/2003

(Continued)

OTHER PUBLICATIONS

3GPP, ETSI TS 126 191 v5.1.0, Release 5, "Universal Mobile Telecommunications System (UTMS); AMR speech codec, wideband; Error concealment of lost frames," Mar. 1, 2002, pp. 1-15.

(Continued)

*Primary Examiner*—Michael N Opsasnick
(74) *Attorney, Agent, or Firm*—Dickinson Wright PLLC

(57) ABSTRACT

There is provided a scalable decoding device capable of improving resistance against a transmission error. In the device, a narrow band LSP decoding unit (108) decodes narrow band LSP encoded information corresponding to a core layer of the current encoded information. A storage unit (126) stores a wide band quantized LSP corresponding to an extended layer of the past encoded information as a stored wide band LSP. When the wide band LSP encoded information is lost from the current encoded information, a compensation unit formed by a combination of a frame loss compensation unit (124) and a switching unit (128) generates a compensated wide band LSP by weighted addition of the band conversion LSP of the narrow band quantized LSP and the stored wide band LSP, thereby compensating the decoding signal of the lost wide band LSP encoded information by the compensated wide band LSP.

6 Claims, 7 Drawing Sheets

U.S. PATENT DOCUMENTS

| | | | | |
|---|---|---|---|---|
| 7,502,375 | B2 * | 3/2009 | Hahn et al. | 370/401 |
| 7,610,198 | B2 * | 10/2009 | Thyssen | 704/230 |
| 7,617,096 | B2 * | 11/2009 | Thyssen | 704/219 |
| 2002/0072901 | A1 * | 6/2002 | Bruhn | 704/229 |
| 2003/0078773 | A1 * | 4/2003 | Thyssen | 704/230 |
| 2003/0078774 | A1 * | 4/2003 | Thyssen | 704/230 |
| 2003/0083865 | A1 * | 5/2003 | Thyssen | 704/205 |
| 2003/0093264 | A1 | 5/2003 | Miyasaka | |
| 2005/0228651 | A1 * | 10/2005 | Wang et al. | 704/207 |

FOREIGN PATENT DOCUMENTS

| | | | |
|---|---|---|---|
| CN | 1511313 | A | 7/2004 |
| EP | 1 202 252 | | 5/2002 |
| JP | 09172413 | | 6/1997 |
| JP | 11030997 | | 2/1999 |
| WO | 02/035520 | | 5/2002 |
| WO | 02/058052 | A1 | 7/2002 |

OTHER PUBLICATIONS

International Search Report dated Nov. 1, 2005.

Hiroyuki Ebara, et al., "Kyotaiiki—Kyotaiiki Yosoku Model ni Motozuku Taiiki Scalable LSP Ryoshika," FIT2004 Koen Ronbunshu, LG-004, pp. 139-141, Aug. 20, 2004.

Chinese Office Action, dated Feb. 12, 2010.

* cited by examiner

SCALABLE DECODING APPARATUS AND METHOD FOR CONCEALING LOST SPECTRAL PARAMETERS

TECHNICAL FIELD

The present invention relates to a scalable decoding apparatus that decodes encoded information comprising scalability in the frequency bandwidth (in the frequency axial direction), and a signal loss concealment method thereof.

BACKGROUND ART

In speech signal encoding in general, the LSP (Linear Spectral Pairs) parameter is widely used as a parameter for efficiently presenting spectral envelope information. LSP is also referred to as LSF (Linear Spectral Frequency).

LSP parameter (hereinafter simply "LSP") encoding is an essential elemental technology of speech encoding technology for encoding speech signals at high efficiency, and is an important elemental technology in band scalable speech encoding which hierarchically encodes speech signals to generate narrowband signals and wideband signals associated with the core layer and enhancement layer, respectively, as well.

Patent Document 1 describes one example of a conventional method used to decode encoded LSP obtained from band scalable speech encoding. The scalable decoding method disclosed adds a component decoded in an enhancement layer to 0.5 times the narrowband decoded LSP of the core layer to obtain a wideband decoded LSP.

However, when the above-mentioned encoded LSP is transmitted, a part of the encoded LSP may be lost on the transmission path. When a part of the LSP does not arrive on the decoding side, the decoding side requires a process for concealing the lost information. Thus, in speech communication performed under a system environment where errors may occur during information transmission, use of a loss concealment process is an important elemental technology for improvement of the error resistance of a speech encoding/decoding system. For example, in the loss concealment method described in Patent Document 2, when the LSP of higher seven of ten orders, that were divided prior to transmission into three lower orders and seven higher orders, does not arrive on the decoding side, the LSP of the last successfully decoded seven higher orders is used repeatedly as the decoded value.

Patent Document 1 Japanese Patent Application Laid-Open HEI11-30997

Patent Document 2 Japanese Patent Application Laid-Open HEI9-172413

DISCLOSURE OF THE INVENTION

Problems to be Solved by the Invention

Nevertheless, in the above-mentioned conventional scalable decoding method, a concealment process for the part of the transmitted encoded LSP that was lost is not performed, resulting in problems such as the inability to improve resistance to transmission errors that may occur due to the system environment.

It is therefore an object of the present invention to provide a scalable decoding apparatus that is capable of improving resistance to transmission errors, and a signal loss concealment method.

Means for Solving the Problem

The scalable decoding apparatus of the present invention employs a configuration having a decoding section that decodes narrowband spectral parameters corresponding to a core layer of a first scalable encoded signal, a storage section that stores wideband spectral parameters corresponding to an enhancement layer of a second scalable encoded signal which differs from the first scalable encoded signal, and a concealment section that generates, when wideband spectral parameters of the second scalable encoded signal are lost, a loss concealment signal by weighted addition of the band converted signal of the decoded narrowband spectral parameters and the stored wideband spectral parameters and conceals the decoded signal of the lost wideband spectral parameters using the loss concealment signal.

The signal loss concealment method of the present invention generates, when wideband spectral parameters corresponding to an enhancement layer of the current scalable encoded signal are lost, a loss concealment signal by weighted addition of the band converted signal of the decoded narrowband spectral parameters corresponding to a core layer of the current scalable encoded signal and the wideband spectral parameters corresponding to an enhancement layer of a past scalable encoded signal, and conceals the decoded signal of the lost wideband spectral parameters with the loss concealment signal.

ADVANTAGEOUS EFFECT OF THE INVENTION

According to the present invention, it is possible to improve robustness against transmission errors.

BEST MODE FOR CARRYING OUT THE INVENTION

Now embodiments of the present invention will be described in detail with reference to the accompanying drawings.

Embodiment 1

Figure 1:
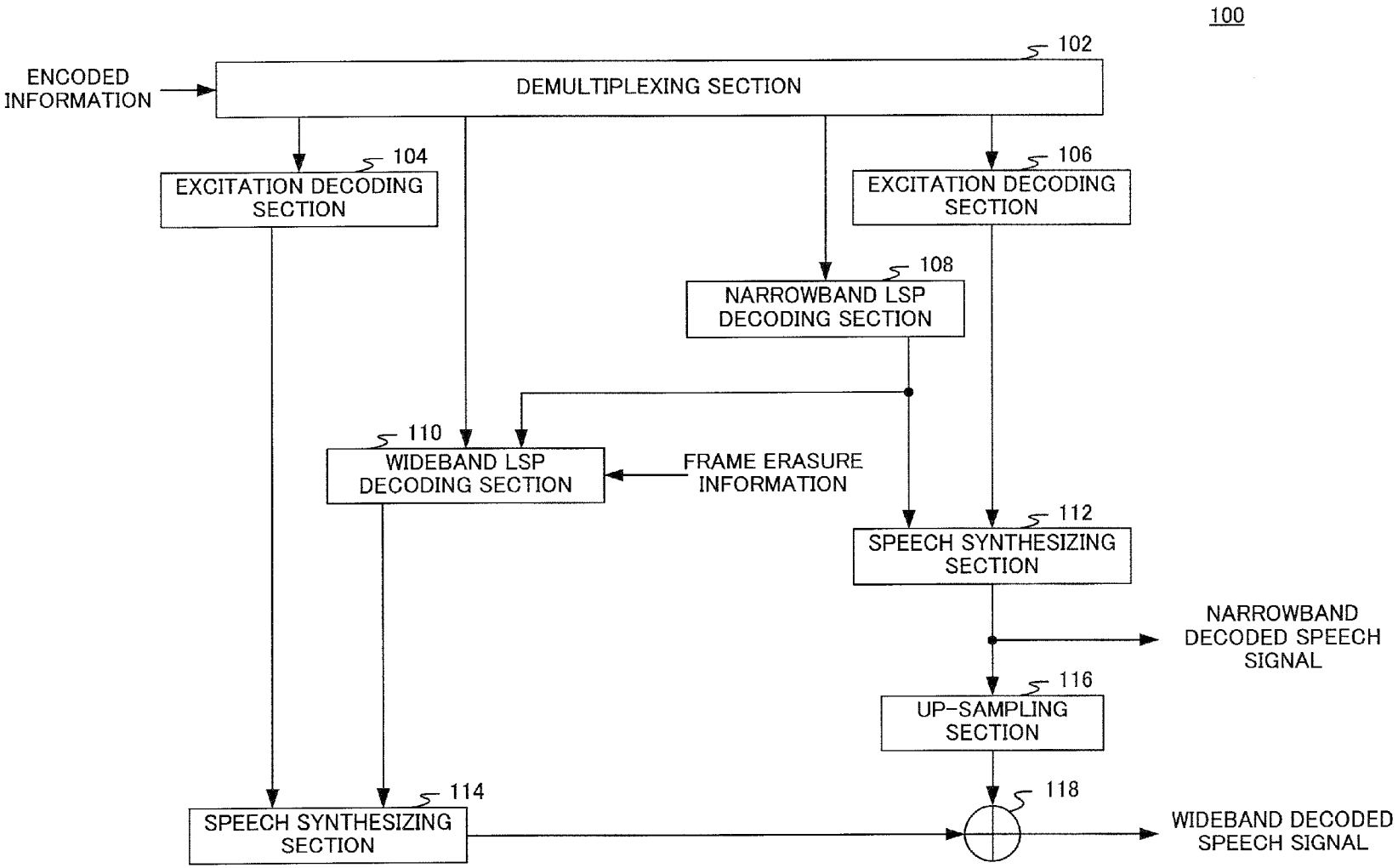
FIG. 1 is a block diagram showing the configuration of the scalable decoding apparatus according to Embodiment 1 of the present invention.
Figure 2:
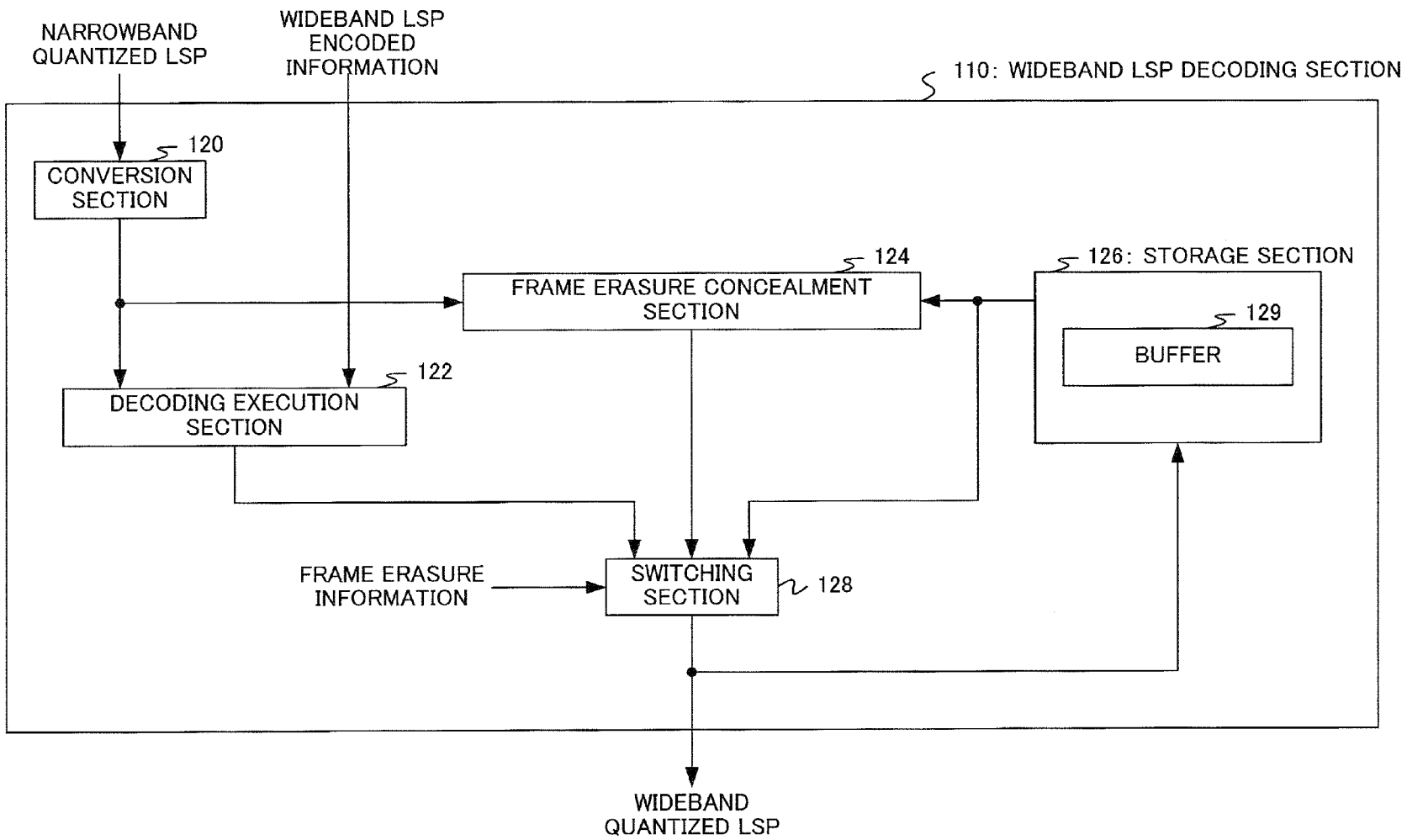
FIG. 2 is a block diagram showing the configuration of the wideband LSP decoding section according to Embodiment 1 of the present invention.
Figure 3:
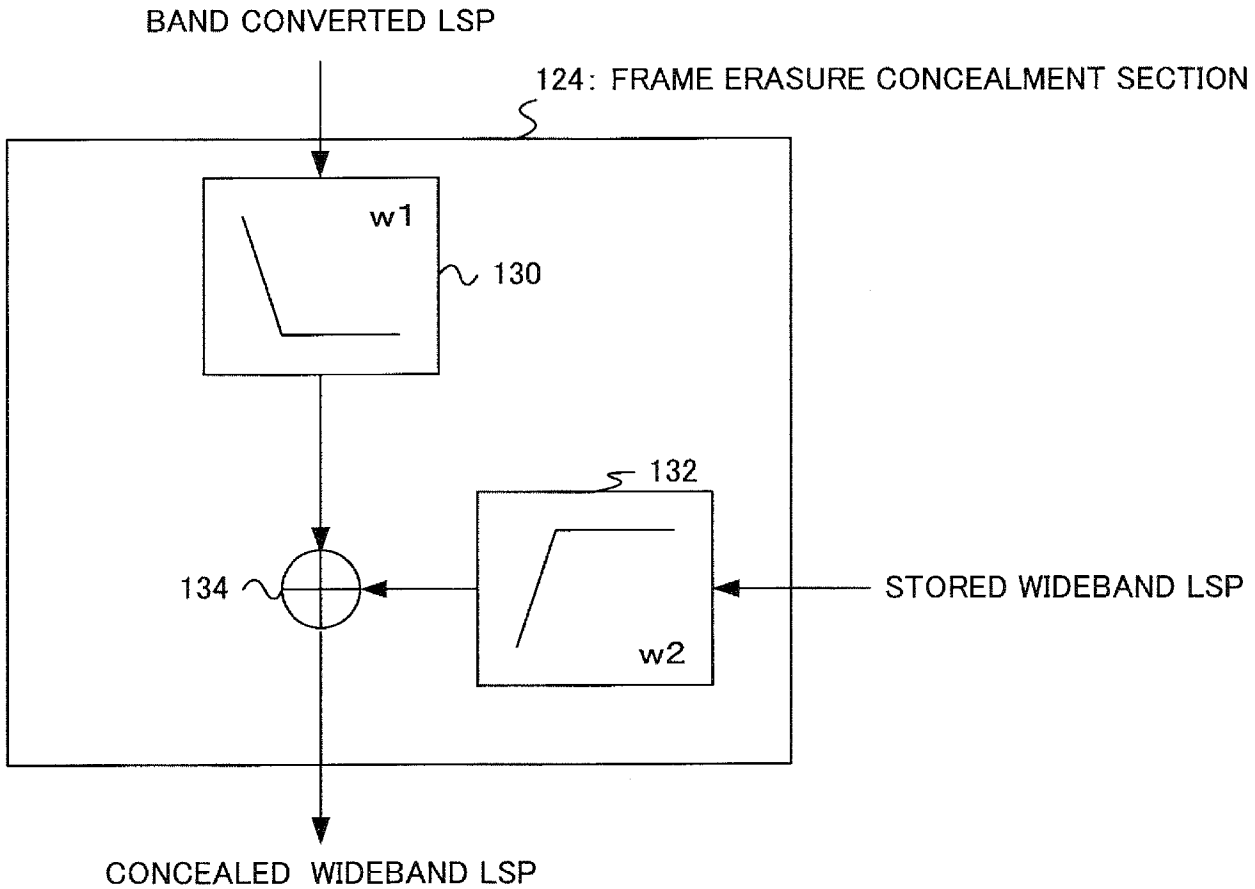
FIG. 3 is a block diagram showing the configuration of the frame erasure concealment section according to Embodiment 1 of the present invention.

FIG. 1 is a block diagram showing the relevant parts of the configuration of the scalable decoding apparatus according to Embodiment 1 of the present invention. Scalable decoding apparatus 100 of FIG. 1 comprises demultiplexing section 102, excitation decoding sections 104 and 106, narrowband LSP decoding section 108, wideband LSP decoding section 110, speech synthesizing sections 112 and 114, up-sampling section 116, and addition section 118. FIG. 2 is a block diagram showing the internal configuration of wideband LSP decoding section 110, which comprises conversion section 120, decoding execution section 122, frame erasure concealment section 124, storage section 126, and switching section 128. Storage section 126 comprises buffer 129. FIG. 3 is a block diagram showing the internal configuration of frame erasure concealment section 124, which comprises weighting sections 130 and 132 and addition section 134.

Demultiplexing section 102 receives encoded information. Here, the encoded information received in demultiplexing section 102 is a signal generated by hierarchically encoding the speech signal in the scalable encoding apparatus (not shown). During speech encoding in the scalable encoding apparatus, encoded information comprising narrowband excitation encoded information, wideband excitation encoded information, narrowband LSP encoded information, and wideband LSP encoded information is generated. The narrowband excitation encoded information and narrowband LSP encoded information are signals generated in association with the core layer, and the wideband excitation encoded information and wideband LSP encoded information are signals generated in association with an enhancement layer.

Demultiplexing section 102 demultiplexes the received encoded information into the encoded information of each parameter. The demultiplexed narrowband excitation encoded information, the demultiplexed narrowband LSP encoded information, the demultiplexed wideband excitation encoded information, and the demultiplexed wideband LSP encoded information are output to excitation decoding section 106, narrowband LSP decoding section 108, excitation decoding section 104, and wideband LSP decoding section 110, respectively.

Excitation decoding section 106 decodes the narrowband excitation encoded information inputted from demultiplexing section 102 to obtain the narrowband quantized excitation signal. The narrowband quantized excitation signal is output to speech synthesizing section 112.

Narrowband LSP decoding section 108 decodes the narrowband LSP encoded information inputted from demultiplexing section 102 to obtain the narrowband quantized LSP. The narrowband quantized LSP is output to speech synthesizing section 112 and wideband LSP decoding section 110.

Speech synthesizing section 112 converts the narrowband quantized LSP inputted from narrowband LSP decoding section 108 into linear prediction coefficients, and constructs a linear predictive synthesis filter using the obtained linear predictive coefficients. In addition, speech synthesizing section 112 activates the linear predictive synthesis filter with the narrowband quantized speech signal inputted from excitation decoding section 106 to synthesize the decoded speech signal. This decoded speech signal is output as a narrowband decoded speech signal. In addition, the narrowband decoded speech signal is output to up-sampling section 116 to obtain the wideband decoded speech signal. Furthermore, the narrowband decoded speech signal may be used as the final output as is. When the narrowband decoded speech signal is used as the final output as is, the speech signal is typically output after post-processing using a post filter to improve the perceptual quality.

Up-sampling section 116 up-samples the narrowband decoded speech signal inputted from speech synthesizing section 112. The up-sampled narrowband decoded speech signal is output to addition section 118.

Excitation decoding section 104 decodes the wideband excitation encoded information inputted from demultiplexing section 102 to obtain the wideband quantized excitation signal. The obtained wideband quantized excitation signal is output to speech synthesizing section 114.

Based on the frame loss information described hereinafter that is inputted from the frame loss information generation section (not shown), wideband LSP decoding section 110 obtains the wideband quantized LSP from the narrowband quantized LSP inputted from narrowband LSP decoding section 108 and the wideband LSP encoded information inputted from demultiplexing section 102. The obtained wideband quantized LSP is output to speech synthesizing section 114.

Now the internal configuration of wideband LSP decoding section 110 will be described in detail with reference to FIG. 2.

Conversion section 120 multiplies the narrowband quantized LSP inputted from narrowband LSP decoding section 108 by a variable or fixed conversion coefficient. As a result of this multiplication, the narrowband quantized LSP is converted from a narrowband frequency domain to a wideband frequency domain to obtain a band converted LSP. The obtained band converted LSP is output to decoding execution section 122 and frame erasure concealment section 124.

Furthermore, conversion section 120 may perform conversion using a process other than the process that multiplies the narrowband quantized LSP by a conversion coefficient. For example, non-linear conversion using a mapping table may be performed, or the process may include conversion of the LSP to autocorrection coefficients and subsequent up-sampling in the domain of the autocorrection coefficient.

Decoding execution section 122 decodes the wideband LSP residual vector from the wideband LSP encoded information inputted from demultiplexing section 102. Then, the wideband LSP residual vector is added to the band converted LSP inputted from conversion section 120. In this manner, the wideband quantized LSP is decoded. The obtained wideband quantized LSP is output to switching section 128.

The configuration of decoding execution section 122 is not limited to the configuration described above. For example, decoding execution section 122 may comprise an internal codebook. In this case, decoding execution section 122 decodes the index information from the wideband LSP encoded information inputted from demultiplexing section 102 to obtain the wideband LSP using the LSP vector identified by the index information. In addition, a configuration that decodes the wideband quantized LSP using, for example, past decoded wideband quantized LSP, past input wideband encoded information, or past band converted LSP inputted from conversion section 120, is also possible.

Frame erasure concealment section 124 calculates the weighted addition of the band converted LSP inputted from conversion section 120 and the stored wideband LSP stored in buffer 129. As a result, the concealed wideband LSP is generated. The weighted addition will be described hereinafter. When a part of the frames of the wideband LSP encoded information included in the encoded information corresponding to the input band converted LSP is lost on the transmission path, the concealed wideband LSP is used to conceal the wideband quantized LSP, which is the decoded signal of the wide band LSP encoded information. The generated concealed wideband LSP is output to switching section 128.

Storage section 126 stores in advance in the internally established buffer 129 the stored wideband LSP used to generate the concealed wideband LSP in frame erasure concealment section 124, and outputs the stored wideband LSP to frame erasure concealment section 124 and switching section 128. In addition, the stored wideband LSP stored in buffer 129 is updated using the wideband quantized LSP inputted from switching section 128.

As a result, the stored wideband LSP is updated using the wideband quantized LSP inputted from switching section 128. Thus, when subsequent encoded information, particularly wideband LSP encoded information included in the encoded information immediately after the current encoded data, is lost, the wideband quantized LSP generated for the wideband LSP encoded information of the current encoded information is used as the stored wideband LSP to generate the concealed wideband LSP for the wideband LSP encoded information of the subsequent encoded information.

Switching section 128, in accordance with the input frame loss information, switches the information output as the wideband quantized LSP to speech synthesizing section 114.

More specifically, when the input frame loss information indicates that all narrowband LSP encoded information and the wideband LSP encoded information included in the encoded information has been successfully received, switching section 128 outputs the wideband quantized LSP inputted from decoding execution section 122 as is to speech synthesizing section 114 and storage section 126. When the input frame loss information indicates that the narrowband LSP encoded information included in the encoded information along with the wideband LSP encoded information was successfully received, but at least a part of the wideband LSP encoded information was lost, switching section 128 outputs the concealed wideband LSP inputted from frame erasure concealment section 124 as the wideband quantized LSP to speech synthesizing section 114 and storage section 126. In addition, when the input frame loss information indicates that at least a part of both the narrowband LSP encoded information and wideband LSP encoded information included in the encoded information has been lost, switching section 128 outputs the stored wideband LSP inputted from storage section 126 as the wideband quantized LSP to speech synthesizing section 114 and storage section 126.

That is, when wideband LSP encoded information included in the encoded information input to demultiplexing section 102 is lost, the combination of frame erasure concealment section 124 and switching section 128 constitutes a concealment section that generates an erasure concealment signal by weighted addition of the band converted LSP obtained from the decoded narrowband quantized LSP and the stored wideband LSP stored in advance in buffer 129, and conceals the wideband quantized LSP of the lost wideband signal using the erasure concealment signal.

Now the internal configuration of frame erasure concealment section 124 will be described in detail with reference to FIG. 3. Weighting section 130 multiplies the band converted LSP inputted from conversion section 120 by weighting coefficient w1. The LSP vector obtained as a result of this multiplication is output to addition section 134. Weighting section 132 multiplies the stored wideband LSP inputted from storage section 126 by weighting coefficient w2. The LSP vector obtained as a result of this multiplication is output to addition section 134. Addition section 134 adds the respective LSP vectors inputted from weighting sections 130 and 132. As a result of this addition, a concealed wideband LSP is generated.

Now FIG. 1. will be referred to once again. Speech synthesizing section 114 converts the quantized wideband LSP inputted from wideband LSP decoding section 110 into linear prediction coefficients, and constructs a linear predictive synthesis filter using the obtained linear predictive coefficients. In addition, speech synthesizing section 114 activates the linear prediction synthesis filter with the wideband quantized excitation signal inputted from excitation decoding section 104 to synthesize the decoded speech signal. This decoded speech signal is output to addition section 118.

Addition section 118 adds the up-sampled narrowband decoded speech signal that is inputted from up-sampling section 116 and the decoded speech signal inputted from speech synthesizing section 114. Then, a wideband decoded speech signal obtained by this addition is output.

Next, the operation, particularly the weighted addition process of scalable decoding apparatus 100 comprising the above configuration will be described.

Figure 4A:
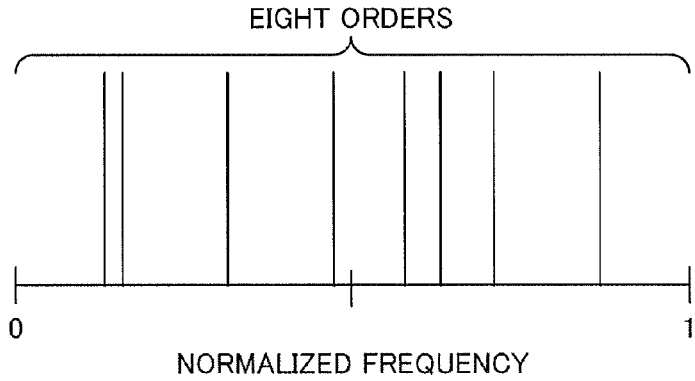
FIG. 4A is a diagram showing the quantized LSP according to Embodiment 1 of the present invention.

Here, the description will be based on an example where the frequency domain of the narrowband corresponding to the core layer is 0 to 4 kHz, the frequency domain of the wideband corresponding to the enhancement layer is 0 to 8 kHz, and the conversion coefficient used in conversion section 120 is 0.5, and will be given with reference to FIG. 4A to FIG. 4D. In FIG. 4A, the sampling frequency is 8 kHz and the Nyquist frequency is 4 kHz, and in FIG. 4B to FIG. 4D, the sampling frequency is 16 kHz and the Nyquist frequency is 8 kHz.

Figure 4B:
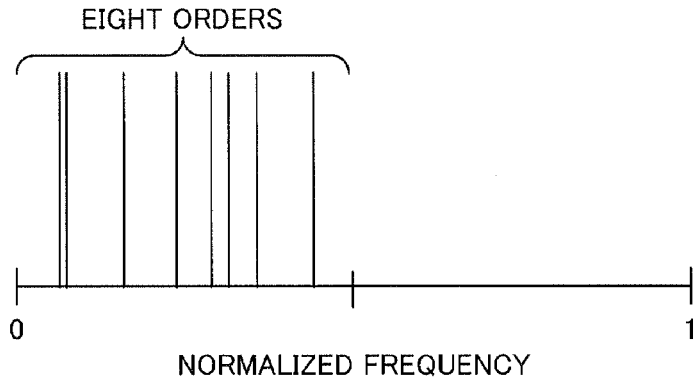
FIG. 4B is a diagram showing the band converted LSP according to Embodiment 1 of the present invention.

Conversion section 120 converts, for example, the quantized LSP of the 4 kHz band shown in FIG. 4A to the quantized LSP of the 8 kHz band by multiplying the LSP of each order of the input current narrowband quantized LSP by 0.5, to generate, for example, the band converted LSP shown in FIG. 4B. Furthermore, conversion section 120 may convert the bandwidth (sampling frequency) using a method different from that described above. Moreover, here, the number of orders of the wideband quantized LSP is 16, with orders 1 to 8 defined as low band and 9 to 16 defined as high band.

The band converted LSP is input to weighting section 130. Weighting section 130 multiplies the band converted LSP inputted from conversion section 120 by weighting coefficient w1 (i) set by the following equations (1) and (2). In addition, the input band converted LSP is derived from the current encoded information obtained in demultiplexing section 102. Further, i indicates the order.

$$w1(i)=(9-i)/8(i=1 \text{ to } 8) \quad (1)$$

$$w1(i)=0(i=9 \text{ to } 16) \quad (2)$$

Figure 4C:
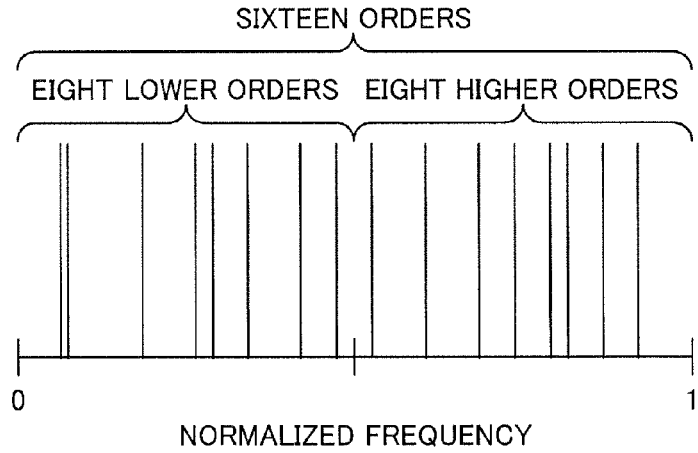
FIG. 4C is a diagram showing the wideband LSP according to Embodiment 1 of the present invention.
Figure 4D:
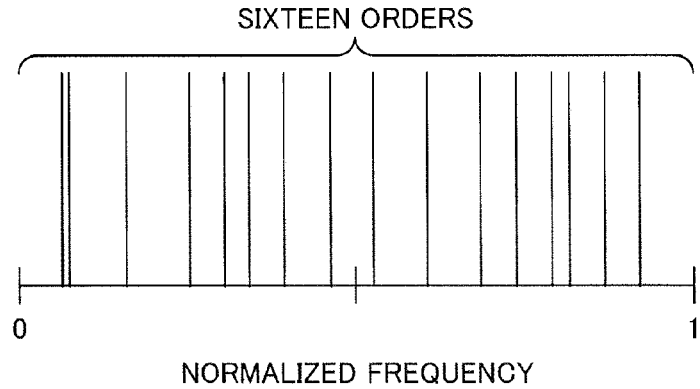
FIG. 4D is a diagram showing the concealed wideband LSP according to Embodiment 1 of the present invention.

On the other hand, the stored wideband LSP shown in FIG. 4C, for example, is input to weighting section 132. Weighting section 132 multiplies the stored wideband LSP inputted from storage section 126 by weighting coefficient w2 (i) set by the following equations (3) and (4). In addition, the input stored wideband LSP is derived from the encoded information obtained (in the frame immediately before the current encoded information, for example) prior to the current encoded information in demultiplexing section 102.

$$w2(i)=(i-1)/8(i=1 \text{ to } 8) \quad (3)$$

$$w2(i)=1(i=9 \text{ to } 16) \quad (4)$$

That is, weighting coefficient w1 (i) and weighting coefficient w2 (i) are set so that w1 (i)+w2 (i)=1.0. In addition, weighting coefficient w1 (i) is set within the range 0 to 1 to a value that decreases as the frequency approaches the high band, and is set to 0 in the high band. In addition, weighting coefficient w2 (i) is set within the range 0 to 1 to a value that increases as the frequency approaches the high band, and is set to 1 in the high band.

Then, addition section 134 finds the sum vector of the LSP vector obtained by multiplication in weighting section 130 and the LSP vector obtained by multiplication in weighting section 132. By finding the sum vector of the above LSP vectors, addition section 134 obtains the compensated wideband LSP shown in FIG. 4D, for example.

Ideally, weighting coefficients w1 (i) and w2 (i) are set adaptively, according to whether the band converted LSP obtained through narrowband quantized LSP conversion or the stored wideband LSP, which is a past decoded wideband quantized LSP, is closer to the error-free decoded wideband quantized LSP. That is, the weighting coefficients are best set so that weighting coefficient w1 (i) is larger when the band converted LSP is closer to the error-free wideband quantized LSP, and weighting coefficient w2 (i) is larger when the stored wideband LSP is closer to the error-free wideband quantized LSP. However, setting the ideal weighting coefficient is actually difficult since the error-free wideband quantized LSP is not known when frame loss occurs. Nevertheless, when scalable encoding is performed with a 4 kHz band signal and an 8 kHz band signal as described above, a trend emerges where often the stored wideband LSP is closer to the error-free wideband quantized LSP (the error with respect to the error-free wideband quantized LSP is small) when the band is 4 kHz or higher, and the band converted LSP becomes increasingly closer to the error-free wideband LSP (the error with respect to the error-free wideband quantized LSP is small) as the band is closer to 0 Hz when the band is 4 kHz or lower. Thus, the above-mentioned equations (1) to (4) are functions that approximate characteristics, including the above-mentioned error trend. As a result, use of weighting coefficients w1 (i) and w2 (i) defined in equations (1) to (4) enables calculation of the weighted addition taking into consideration the error characteristics identified by the combination of the narrowband frequency band and wideband frequency band, i.e., the error trend between the band converted LSP and error-free wideband quantized LSP. Furthermore, because weighting coefficients w1 (i) and w2 (i) are determined by simple equations such as equations (1) to (4), weighting coefficients w1 (i) and w2 (i) do not need to be stored in ROM (Read Only Memory), thereby achieving effective weighted addition using a simple configuration.

Furthermore, in the present embodiment, the invention was described using as an example of the case where an error variation trend that exhibits increased error as the frequency or order increases exists, but the error variation trend differs according to factors such as the setting condition of the frequency domain of each layer. For example, when the narrowband frequency domain is 300 Hz to 3.4 kHz and the wideband frequency domain is 50 Hz to 7 kHz, the lower limit frequencies differ and, as a result, the error that occurs in the domain of 300 Hz or higher becomes less than or equal to the error that occurs in the domain of 300 Hz or less. In such a case, for example, weighting coefficient w2 (1) may be set to a value greater than or equal to weighting coefficient w2 (2).

That is, the conditions required for setting weighting coefficients w1 (i) and w2 (i) are as follows. The coefficient corresponding to the overlapping band, which is the domain where the narrowband frequency domain and wideband frequency domain overlap, is defined as a first coefficient. The coefficient corresponding to the non-overlapping band, which is the domain where the narrowband frequency domain and wideband frequency domain do not overlap, is defined as a second coefficient. The first coefficient is a variable determined in accordance with the difference between the frequency of the overlapping band or the order corresponding to that frequency and the boundary frequency of the overlapping band and non-overlapping band or the order corresponding to that boundary frequency, and the second coefficient is a constant in the non-overlapping band.

Furthermore, for the first coefficient, a value that decreases as the above-mentioned difference decreases is individually set in association with the band converted LSP, and a value that increases as the above-mentioned difference decreases is individually set in association with the stored wideband LSP. Specifically, the first coefficient may be expressed by a linear equation such as that shown in equations (1) and (3), or the value obtained through training using a speech database, or the like, may be used as the first coefficient. When the first coefficient is obtained through training, the error with respect to the concealed wideband LSP obtained as a result of weighted addition and the error-free wideband quantized LSP is calculated for all speech data of the database, and a weighting coefficient is determined so as to minimize the total error sum.

In this manner, according to the present embodiment, when wideband LSP encoded information of current encoded information is lost, a concealed wideband LSP is generated by weighted addition of the band converted LSP of the narrowband quantized LSP of the encoded signal and the wideband quantized LSP of past encoded information, and the wideband quantized LSP of the lost wideband encoded information is concealed using the concealed wideband LSP, i.e., a concealed wideband LSP for concealing the wideband quantized LSP of the lost wideband encoded information is generated by weighted addition of the band converted LSP of the current encoded information and the wideband quantized LSP of past encoded information. As a result, in comparison to cases where only the wideband quantized LSP of past encoded information or only the narrowband quantized LSP of current encoded information is used to compensate the wideband quantized LSP of the lost wideband LSP encoded information, it is possible to bring the wideband quantized LSP of the concealed wideband LSP encoded information closer to the error free state and, consequently, improve robustness against transmission errors. In addition, according to the present embodiment, it is possible to smoothly connect the band converted LSP of current encoded information and the wideband quantized LSP of past encoded information, making it possible to maintain continuity between the frames of the generated concealed wideband LSP.

Embodiment 2

Figure 5:
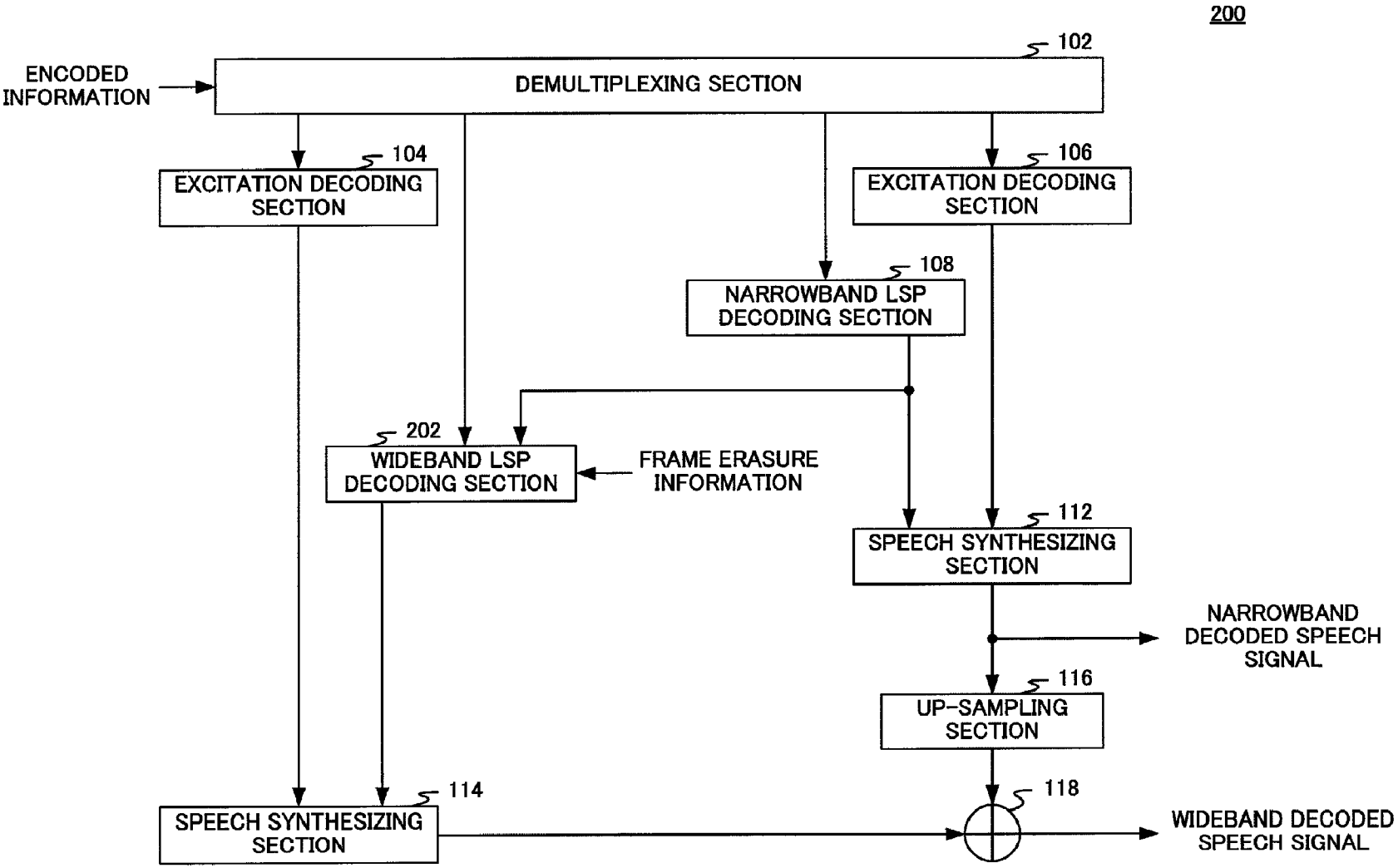
FIG. 5 is a block diagram showing the configuration of the scalable decoding apparatus according to Embodiment 2 of the present invention.

FIG. 5 is a block diagram showing the relevant parts of the configuration of the scalable decoding apparatus according to Embodiment 2 of the present invention. Scalable decoding apparatus 200 of FIG. 5 comprises a basic configuration that is similar to scalable decoding section 100 described in Embodiment 1. Thus, the component elements that are identical to those described in Embodiment 1 use the same reference numerals, and detailed descriptions thereof are omitted.

Figure 6:
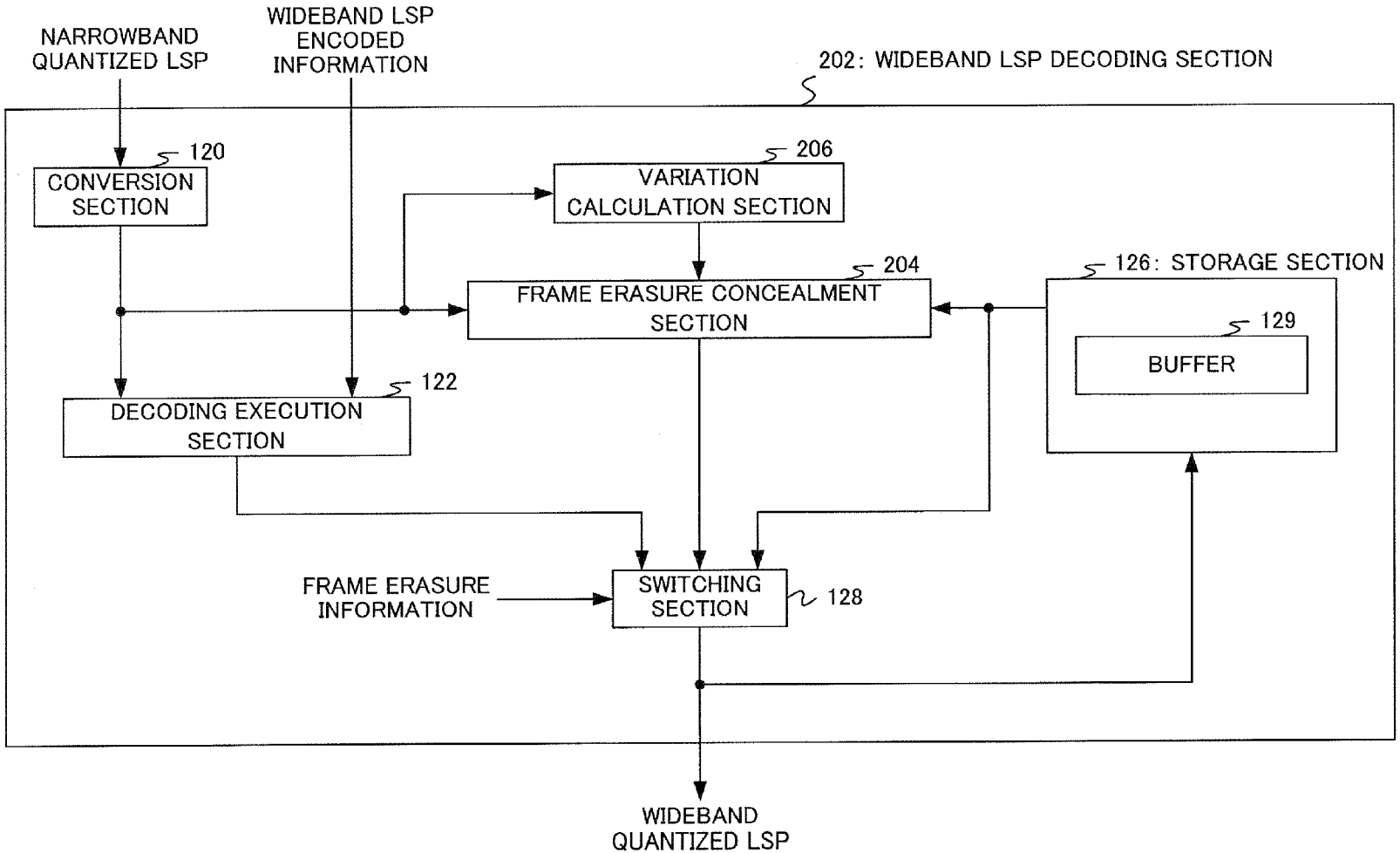
FIG. 6 is a block diagram showing the configuration of the wideband LSP decoding section according to Embodiment 2 of the present invention.
Figure 7:
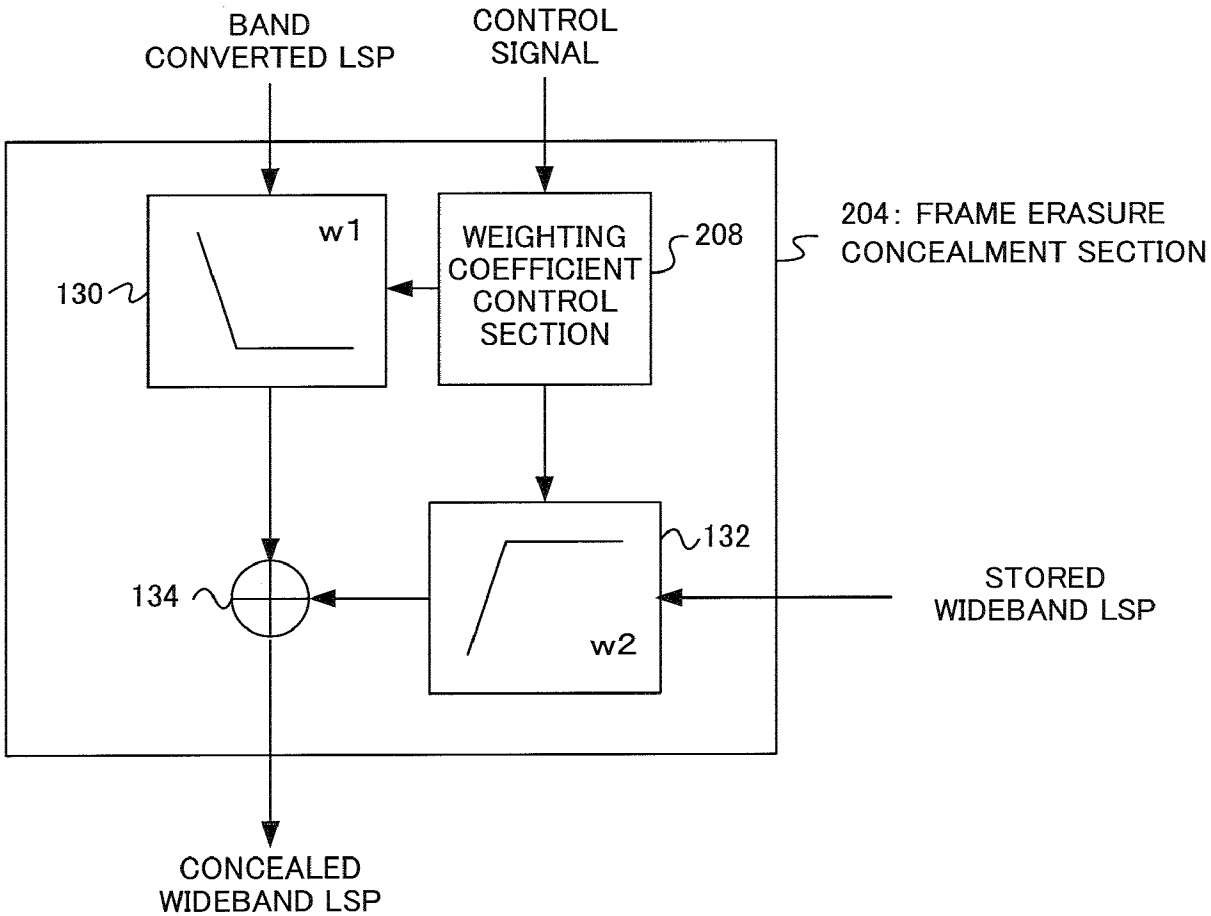
FIG. 7 is a block diagram showing the configuration of the frame erasure concealment section according to Embodiment 2 of the present invention.

Scalable decoding apparatus 200 comprises wideband LSP decoding section 202 in place of wideband LSP decoding section 110 described in Embodiment 1. FIG. 6 is a block diagram showing the internal configuration of wideband LSP decoding section 202. Wideband LSP decoding section 202 comprises frame erasure concealment section 204 in place of frame erasure concealment section 124 described in Embodiment 1. Furthermore, variation calculation section 206 is provided in wideband LSP decoding section 202. FIG. 7 is a block diagram showing the internal configuration of frame erasure concealment section 204. Frame erasure concealment section 204 comprises a configuration with weighting coefficient control section 208 added to the internal configuration of frame erasure concealment section 124.

Wideband LSP decoding section 202, similar to wideband LSP decoding section 110, obtains the wideband quantized LSP from the narrowband quantized LSP inputted from narrowband LSP decoding section 108 and the wideband LSP encoded information inputted from demultiplexing section 102, based on frame loss information.

In wideband LSP decoding section 202, variation calculation section 206 receives the band converted LSP obtained by conversion section 120. Then, variation calculation section 206 calculates the variation between the frames of the band converted LSP. Variation calculation section 206 outputs the control signal corresponding to the calculated inter-frame variation to weighting coefficient control section 208 of frame erasure concealment section 204.

Frame erasure concealment section 204 calculates the weighted addition of the band converted LSP inputted from conversion section 120 and the stored wideband LSP stored in buffer 129, using the same method as frame erasure concealment section 124. As a result, the concealed wideband LSP is generated.

While the weighted addition of Embodiment 1 uses as is weighting coefficients w1 and w2 uniquely defined by order i or the corresponding frequency, the weighted addition of the present embodiment adaptively controls weighting coefficients w1 and w2.

In frame erasure concealment section 204, weighting coefficient control section 208, in w1 (i) and w2 (i) of the entire band, adaptively changes the weighting coefficients w1 (i) and w2 (i) that correspond to the overlapping band (defined as "the first coefficient" in Embodiment 1), in accordance with the control signal inputted from variation calculation section 206.

More specifically, weighting coefficient control section 208 sets the values so that weighting coefficient w1 (i) increases and, in turn, weighting coefficient w2 (i) decreases as the calculated inter-frame variation increases. In addition, weighting coefficient control section 208 sets the values so that weighting coefficient w2 (i) increases and, in turn, weighting coefficient w1 (i) decreases as the calculated inter-frame variation decreases.

One example of the above-mentioned control method includes switching the weighting coefficient set that includes weighting coefficient w1 (i) and weighting coefficient w2 (i) in accordance with the result of comparing the calculated inter-frame variation and a specific threshold value. When this control method is employed, weighting coefficient control section 208 stores in advance the weighting coefficient set WS1 corresponding to inter-frame variation of the threshold value or higher, and weighting coefficient set WS2 corresponding to inter-frame variation less than the threshold value. Weighting coefficient w1 (i) included in weighting coefficient set WS1 is set to a value that is larger than weighting coefficient w1 (i) included in weighting coefficient set WS2, and weighting coefficient w2 (i) included in weighting coefficient set WS1 is set to a value that is smaller than weighting coefficient w2 (i) included in weighting coefficient set WS2.

Then, when as a result of comparison the calculated inter-frame variation is greater than or equal to the threshold value, weighting coefficient control section 208 controls weighting section 130 so that weighting section 130 uses weighting coefficient w1 (i) of weighting coefficient set WS1, and controls weighting section 132 so that weighting coefficient section 132 uses weighting coefficient w2 (i) of weighting coefficient set WS1. On the other hand, when as a result of comparison the calculated inter-frame variation is less than the threshold value, weighting coefficient control section 208 controls weighting section 130 so that weighting section 130 uses weighting coefficient w1 (i) of weighting coefficient set WS2, and controls weighting section 132 so that weighting section 132 uses weighting coefficient w2 (i) of weighting coefficient set WS2.

In this manner, according to the present embodiment, the present inventions sets the weighting coefficients so that weighting coefficient w1 (i) increases and, in turn, weighting coefficient w2 (i) decreases as the inter-frame variation increases or, on the other hand, weighting coefficient w2 (i) increases and, in turn, weighting coefficient w1 (i) decreases as the calculated inter-frame variation decreases, i.e., weighting coefficients w1 (i) and w2 (i) used for weighted addition are adaptively changed, so that it is possible to adaptively control weighting coefficients w1 (i) and w2 (i) in accordance with the temporal variation of information successfully received, and improve the accuracy of concealment of the wideband quantized LSP.

Furthermore, variation calculation section 206 according to the present embodiment is provided in the second part of conversion section 120 and calculates the inter-frame variation of the band converted LSP. However, the placement and configuration of variation calculation section 206 are not limited to those described above. For example, variation calculation section 206 may also be provided in the first part of conversion section 120. In this case, variation calculation section 206 calculates the inter-frame variation of the narrowband quantized LSP obtained by narrowband LSP decoding section 108. In this case as well, the same action effect as described above can be achieved.

In addition, in variation calculation section 206, the inter-frame variation calculation may be performed individually for each order of the band converted LSP (or narrowband quantized LSP). In this case, weighting coefficient control section 208 controls weighting coefficients w1 (i) and w2 (i) on a per order basis. This further improves the accuracy of concealment of the wideband quantized LSP.

Furthermore, each function block used in the descriptions of the above-mentioned embodiments is representatively presented as an LSI, an integrated circuit. These may be individually developed into single chips or developed into single chips that contain the function blocks in part or in whole.

Here, the term "LSI" is used but, may be referred to as "IC," "system LSI," "super LSI," or "ultra LSI" depending on the difference in the degree of integration.

In addition, the method for integrated circuit development is not limited to LSI's, but may be achieved using dedicated circuits or a general purpose processor. After LSI manufacture, a field programmable gate array (FPGA) that permits programming or a reconfigurable processor that permits reconfiguration of LSI internal circuit cell connections and settings may be utilized.

Further, if the technology for developing an integrated circuit that replaces the LSI emerges as a result of the progress in semiconductor technology or another derivative technology, the function blocks may of course be integrated using that technology. The application in biotechnology is also possible.

The present application is based on Japanese Patent Application No. 2004-258925, filed on Sep. 6, 2004, the entire content of which is expressly incorporated by reference herein.

INDUSTRIAL APPLICABILITY

The scalable decoding apparatus and signal loss concealment method of the present invention can be applied to a communication apparatus in, for example, a mobile communication system or packet communication system based on Internet protocol.

The invention claimed is:

1. A scalable decoding apparatus comprising:

a decoding section that decodes narrowband spectral parameters corresponding to a core layer of a first scalable encoded signal;

a storage section that stores wideband spectral parameters corresponding to an enhancement layer of a second scalable encoded signal, which differs from the first scalable encoded signal; and a concealment section that generates, when wideband spectral parameters corresponding to the enhancement layer of the second scalable encoded signal are lost, a loss concealment signal by weighted addition of a band converted signal of the decoded narrowband spectral parameters and the stored wideband spectral parameters, and conceals a decoded signal of the lost wideband spectral parameters using the loss concealment signal, wherein:

the narrowband spectral parameters of the first scalable encoded signal comprise a first frequency band, and the wideband spectral parameters of the second scalable encoded signal comprise a second frequency band, which is broader than the first frequency band;

the scalable decoding apparatus further comprises a conversion section that converts the decoded narrowband spectral parameters from the first frequency band to the second frequency band to generate the band converted signal; and the concealment section calculates a weighted addition using weighting coefficients set based on the first frequency band and the second frequency band.

2. The scalable decoding apparatus according to claim 1, wherein the concealment section calculates the weighted addition using weighting coefficients given by a frequency function that approximates an error with respect to the band converted signal and error-free wideband spectral parameters.

3. The scalable decoding apparatus according to claim 1, wherein:

the concealment section calculates the weighted addition using a first weighting coefficient corresponding to an overlapping band of the first frequency band and the second frequency band, and a second weighting coefficient corresponding to a non-overlapping band of the first frequency band and the second frequency band; and the first weighting coefficient is a variable determined according to the difference between a frequency of the overlapping band and the boundary frequency of the overlapping band and non-overlapping band, and the second weighting coefficient is a constant in the non-overlapping band.

4. The scalable decoding apparatus according to claim 1, wherein:

the concealment section calculates the weighted addition using weighting coefficients individually set for the band converted signal or the wideband spectral parameters, and determined in accordance with the difference between a frequency of the overlapping band where the first frequency band and the second frequency band overlap, and the boundary frequency of the overlapping band;

the set weighting coefficient of the band converted signal comprises a value that decreases as the difference decreases, and the set weighting coefficient of the wideband spectral parameters comprises a value that increases as the difference decreases.

5. The scalable decoding apparatus according to claim 1, wherein the concealment section changes individually set weighting coefficients of the band converted signal and wideband spectral parameters in accordance with the inter-frame variation of the decoded narrowband spectral parameters.

6. A scalable decoding method comprising:

a decoding step wherein a circuit apparatus decodes narrowband spectral parameters corresponding to a core layer of a first scalable encoded signal; and a concealment step of generating, when wideband spectral parameters corresponding to an enhancement layer of a second scalable encoded signal which differs from the first scalable encoded signal are lost, a loss concealment signal by weighted addition of a band converted signal of the decoded narrowband spectral parameters and the wideband spectral parameters, and concealing a decoded signal of the lost wideband spectral parameters using the loss concealment signal, wherein:

the narrowband spectral parameters of the first scalable encoded signal comprise a first frequency band, and the wideband spectral parameters of the second scalable encoded signal comprise a second frequency band, which is broader than the first frequency band;

the scalable decoding method further comprises a conversion step of converting the decoded narrowband spectral parameters from the first frequency band to the second frequency band to generate the band converted signal; and the concealment step calculates a weighted addition using weighting coefficients set based on the first frequency band and the second frequency band.

* * * * *